US005785410A

United States Patent [19]

Branson, Sr.

[11] Patent Number: 5,785,410

[45] Date of Patent: Jul. 28, 1998

[54] ELECTRONIC ROAD BEACON

[76] Inventor: Michael Del Branson, Sr., 13500 Duggan Rd., Central Point, Oreg. 97502

[21] Appl. No.: 654,266

[22] Filed: May 28, 1996

[51] Int. Cl.[6] ..... E01F 9/00; F21S 1/02; F21L 7/00; F21L 15/06

[52] U.S. Cl. ..... 362/153.1; 362/153; 362/157; 362/158; 362/183; 362/257

[58] Field of Search ..... 362/35, 153.1, 362/183, 186, 191, 243, 297, 800, 153, 157, 158, 200, 257, 263, 265, 362, 372, 145, 285

[56] References Cited

U.S. PATENT DOCUMENTS

| | | | |
|---|---|---|---|
| 1,265,386 | 5/1918 | Richards | 362/153.1 |
| 1,425,139 | 8/1922 | Rumsey | 362/153.1 |
| 1,425,140 | 8/1922 | Rumsey | 362/153.1 |
| 1,480,037 | 1/1924 | Wyatt | 362/153.1 |
| 1,491,145 | 4/1924 | Lange et al. | 362/153.1 |
| 1,518,678 | 12/1924 | Sovereign | 362/153.1 |
| 1,572,214 | 2/1926 | McEwing et al. | 362/145 |
| 1,839,276 | 1/1932 | Taylor | 362/153.1 |
| 3,153,745 | 10/1964 | Gurian et al. | 315/206 |
| 3,875,561 | 4/1975 | Scarpino et al. | 362/297 |
| 4,047,150 | 9/1977 | Kelly | 340/84 |
| 4,142,179 | 2/1979 | Lowndes | 340/321 |
| 4,279,433 | 7/1981 | Petaja | 280/605 |
| 4,323,879 | 4/1982 | Kelly | 340/134 |
| 4,613,847 | 9/1986 | Scolari et al. | 362/157 |
| 4,759,735 | 7/1988 | Pagnol et al. | 362/183 |
| 4,827,245 | 5/1989 | Lipman | 362/285 |
| 5,003,215 | 3/1991 | Holten | 313/113 |
| 5,103,383 | 4/1992 | Mayhew | 362/186 |
| 5,122,939 | 6/1992 | Kazdan et al. | 362/243 |
| 5,136,475 | 8/1992 | McDermott | 362/158 |
| 5,203,624 | 4/1993 | Schier et al. | 362/183 |
| 5,213,411 | 5/1993 | Haus et al. | 362/362 |
| 5,262,756 | 11/1993 | Chien | 362/183 |
| 5,294,924 | 3/1994 | Dydzyk | 340/908 |
| 5,319,365 | 6/1994 | Hillinger | 362/191 |
| 5,490,045 | 2/1996 | Lindner | 362/35 |
| 5,521,595 | 5/1996 | Totten et al. | 362/158 |
| 5,556,189 | 9/1996 | Wallis | 362/153.1 |
| 5,622,427 | 4/1997 | Lemons et al. | 362/297 |

*Primary Examiner*—Ira S. Lazarus
*Assistant Examiner*—Matthew J. Spark
*Attorney, Agent, or Firm*—Jacobson, Price, Holman & Stern, PLLC

[57] ABSTRACT

An electronic road beacon is provided with a flashing light. The beacon functions as a traffic alert device by being placed on the surface of a roadway or other surface. Accordingly, the beacon is designed to withstand the impact of a car, truck or other vehicle which may strike or run over the beacon. The beacon comprises three essential components. The first is a circular base plate having a raised annulus around the periphery which defines an interior opening and a bottom portion. The second component is a dome comprising a spherical lens having internal concentric radial freznel and at least one reflector mirror. The dome is mounted to the base plate and define a sealed interior space that is protected from weather and other harmful conditions. The third component is a circuit board that is mounted to the bottom portion of the base plate in the interior space of the beacon. The circuit board contains solid state circuitry and a light emitting bulb. The light is focused and intensified by the dome. In addition, a magnetic ON/OFF switch is activated by a magnetic key to operate the bulb.

39 Claims, 3 Drawing Sheets

ELECTRONIC ROAD BEACON

BACKGROUND OF THE INVENTION

1. Field of the Invention

The present invention relates to a battery powered traffic alert device. More particularly, the present invention relates to electronic road beacons for alerting on-coming motorists and pedestrians to a potentially hazardous roadway or walkway condition.

2. Description of the Related Art

Emergency traffic conditions often arise which require the immediate or special attention of motorists, pedestrians and other thoroughfare users. Emergency situations, for instance, may result from traffic accidents, road construction, road closures, traffic light malfunctions, detours, road obstructions and other temporary or permanent hazards. Often, these hazards are accompanied by inclement weather conditions, such as rain, fog, sleet, snow or dark of night.

Traffic alert devices have been developed to caution roadway users of unusual conditions. Common traffic alert devices include plastic cones or barrels, triangle reflectors, steel or concrete barricades and delineators. However, these devices are difficult to see at night or during inclement weather conditions.

Flares occasionally are used either alone or in conjunction with cones and barricades to increase visibility. Yet, flares can be time consuming and potentially dangerous to ignite. Moreover, flares can cause injury to persons and damage to vehicles that inadvertently come into contact with the flare. Likewise, flares produce gagging fumes and smoke and pose a fire hazard.

Consequently, flares are inappropriate for indoor uses, or for accidents near dry brush or involving chemical spills or gas leaks. In addition, flares have a limited duration and lifespan. Flares may burn out prior to help arriving, or prior to the expiration of the emergency condition. Flares must also be replaced about every three years for maximum effectiveness.

Flashing or rotating warning lights have also been used to alert motorists of hazardous traffic conditions. However, flashing lights are prone to damage and therefore must be mounted to cones or barricades, such as shown by Dydzyk in U.S. Pat. No. 5,294,924 entitled "Flashing Warning Light for a Traffic Control Device." Yet, the flashing light may be damaged if the light becomes separated from the cone or if the cone is inadvertently knocked over. In addition, flashing lights are vulnerable to theft since they can be easily turned ON and OFF.

Other types of warning lights mount magnetically on a car roof and can draw power from the cigarette lighter socket of the car. These warning lights, however, are limited to being placed within reach of a cigarette lighter socket. Also, the car-mounted flashing light is prone to damage if the light becomes dislodged from the car.

SUMMARY OF THE INVENTION

Accordingly, it is a primary object of the present invention to provide a traffic alert device that is highly visible to oncoming traffic.

It is a further object of the present invention to provide a road beacon device that is highly visible but also sufficiently strong and durable that it can be driven over by vehicles, is waterproof and can withstand harsh treatment and environments.

It is yet another object of the present invention to provide an electronic road beacon that is environmentally safe, compact, reusable, can be operated for long periods of time and can be easily and economically manufactured using known components manufacturing techniques.

In accordance with the foregoing objects, the present invention comprises an electronic road beacon that alerts traffic to a road hazard or emergency condition. The electronic road beacon is designed to be placed on the surface of the roadway and can be driven over by a car, truck or other vehicle.

More specifically, the electronic road beacon of the present invention comprises three essential components. The first component is a circular base plate preferably molded from a high strength, high impact plastic material. The base plate is configured to have a circular bottom portion and a raised ring-like structure or annulus around the outer periphery of the base plate. The annulus defines an interior opening for the base plate. The annulus also has an outer beveled face to facilitate vehicles passing over the beacon.

The second component is a dome structure preferably made of a high strength, high impact molded plastic. The dome forms a spherical lens, having a spherical shape radius substantially greater than the height of the dome. The dome has concentric radial freznel cut into its interior surface and at least one reflector mirror. The dome is mounted to the base plate by mating buttress threads associated with the inner surface of the raised annulus. When mounted together, the base plate and the dome define a sealed interior space that is protected from weather and other harmful conditions.

The third component is a light-generating circuit board mounted to the bottom interior opening of the base plate in the interior space of the beacon defined by the base plate and the dome. The circuit board contains solid state circuitry and a light emitting bulb. The light is focused and intensified by the radial freznel of the dome. The bulb and circuitry are powered by rechargeable batteries or the like. An elongated passage is provided through the annulus of the base plate so that the batteries may be recharged through the use of an external plug. In addition, the circuit board contains a magnetic activated switch. Thus, the device can only be turned ON and OFF with the use of a magnetic key, thereby reducing the incentives for theft.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
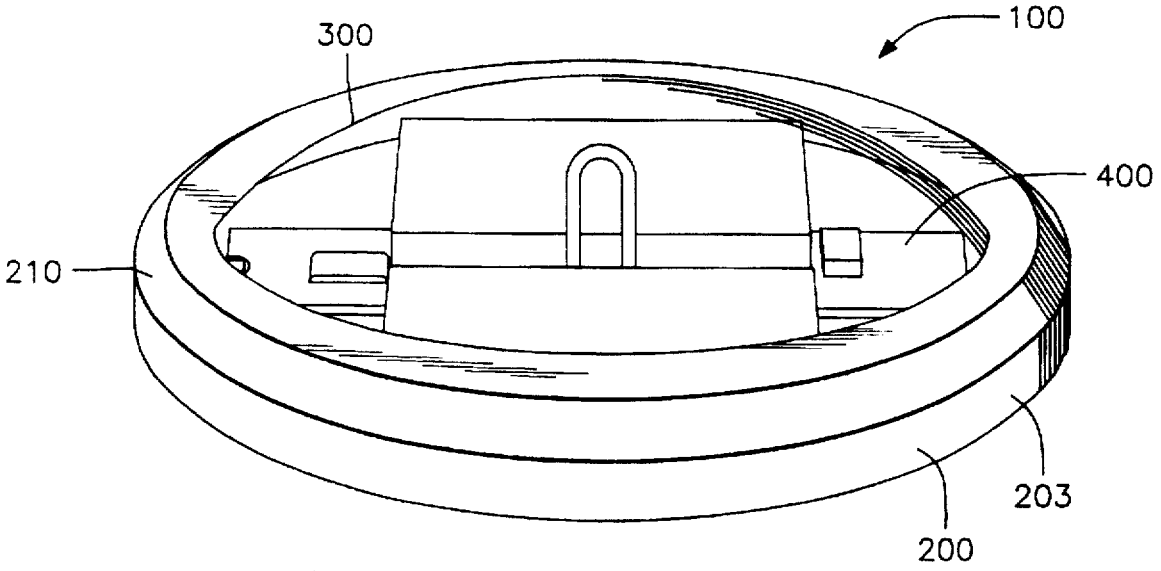
FIG. 1 is an angled perspective of a preferred embodiment of the electronic road beacon in accordance with the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Turning to the drawings, FIG. 1 generally shows a preferred electronic road beacon 100 of the present invention. The beacon 100 is designed to be able to withstand the impact of a vehicle and has endured the force of a 80,000 pound truck traveling at 60 miles per hour. In addition, the beacon 100 is designed to be water proof to a depth of 300 feet. Accordingly, the beacon 100 may be placed on the roadway hundreds of feet from an accident or at the center of the hazard, such as on a disabled car.

The beacon 100 essentially comprises a circular base plate 200, dome 300, and circuit board 400. In the preferred embodiment, dome 300 is made of a high strength, high impact plastic, such as thermoplastic polycarbonate resins and the like. One resin found particularly suitable for the dome of the present invention is "LEXAN" 500 or 503 sold by General Electric Company. Also, in the preferred embodiment, dome 300 is a spherical lens, typically having a thickness of about 0.2800 inches and a radius of about 7.5 inches. However, dome 300 can be a solid core lens, in which the dome may have a conical shape with a flattened top surface (not shown).

In the preferred embodiment, the base plate 200 is also molded of a high strength, high impact plastic, such as LEXAN 500 or 503. Base plate 200 and dome 300 define an interior space for the electronic road beacon 100. Base plate 200 has an interior opening on which circuit board 400 is mounted and receives dome 300 thereon in tight sealing engagement. Accordingly, circuit board 400 is sealingly enclosed within the interior space of beacon 100 and thereby protected from adverse weather and other harmful conditions.

Figure 2:
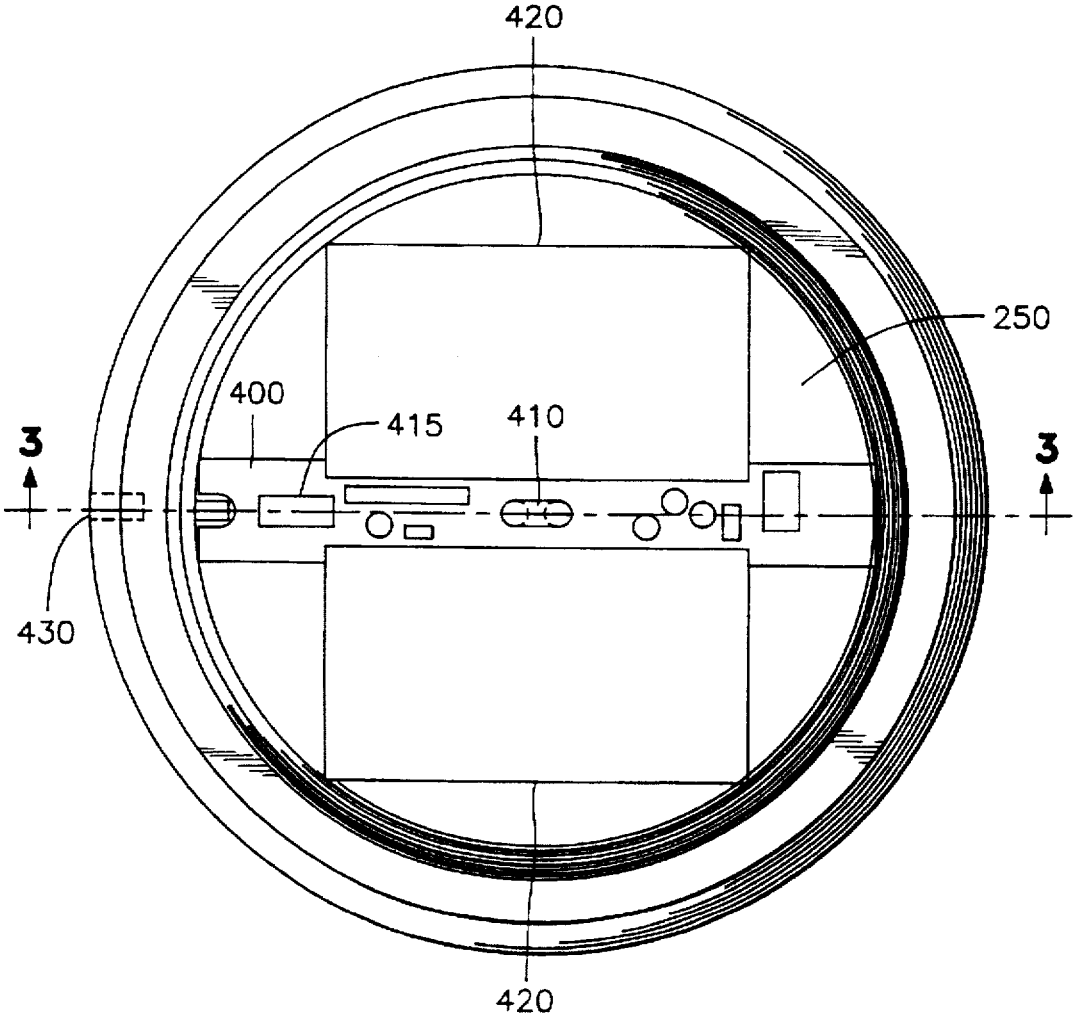
FIG. 2 is a top view of the preferred electronic road beacon in accordance with the present invention.

As shown in FIG. 2, circuit board 400 has a bulb 410, solid state circuitry to control the operation of bulb 410, an ON/OFF switch 415 for activating and de-activating the circuitry, and batteries 420 for powering the circuitry. An elongated switch controller (not shown) extends through the bottom portion 202 of base plate 200 in order to turn the bulb 410 ON and OFF.

In the preferred embodiment, circuit board 400 is potted in a tinted resin core plastic. The circuit board 400 is potted by first connecting all the solid state elements and Xenon bulb 410. The assembled circuit board 400 is placed in a mold and the entire board is encased in the potting material, preferably on the order of ⅛ inch thick, the bulb 410 then extends outside the pot. In this manner, the bulb 410 becomes affixed to circuit board 400 in a permanent fashion.

Once the potting material sets, the encased circuit board 400 is adhered to the bottom portion 202 of base plate 200. The potting material is preferably dyed black so that the circuitry is concealed from view. The potted circuit board 400 is further coated with an aluminum oxide reflective surface to reflect incident light from bulb 410. The potted circuit board 400 provides a level top surface that furnishes a better and more consistent reflection of incident light.

An indentation or opening 215 is made on the underside of base plate 200 to enable magnetic switch 415 to be operated through the lower surface of the base plate 200. Alternatively, the indentation or opening may be located on the outer edge 203 of base plate 200. In addition, a magnetically actuated switch may be used so that no opening is required.

In the preferred embodiment, bulb 410 is a Xenon strobe tube, such as the "SAFE HOUSE" Emergency Strobe Light available at Radio Shack. Bulb 410 provides an extremely high intensive burst of light having a half second duration and repeating between one second pause. In addition, circuit board 400 is associated with battery recharge receptacle 430, as will be discussed below in relation with FIG. 3. A coaxial plug (not shown) may be inserted into recharge receptacle 430 in order to recharge batteries 420.

Figure 3:
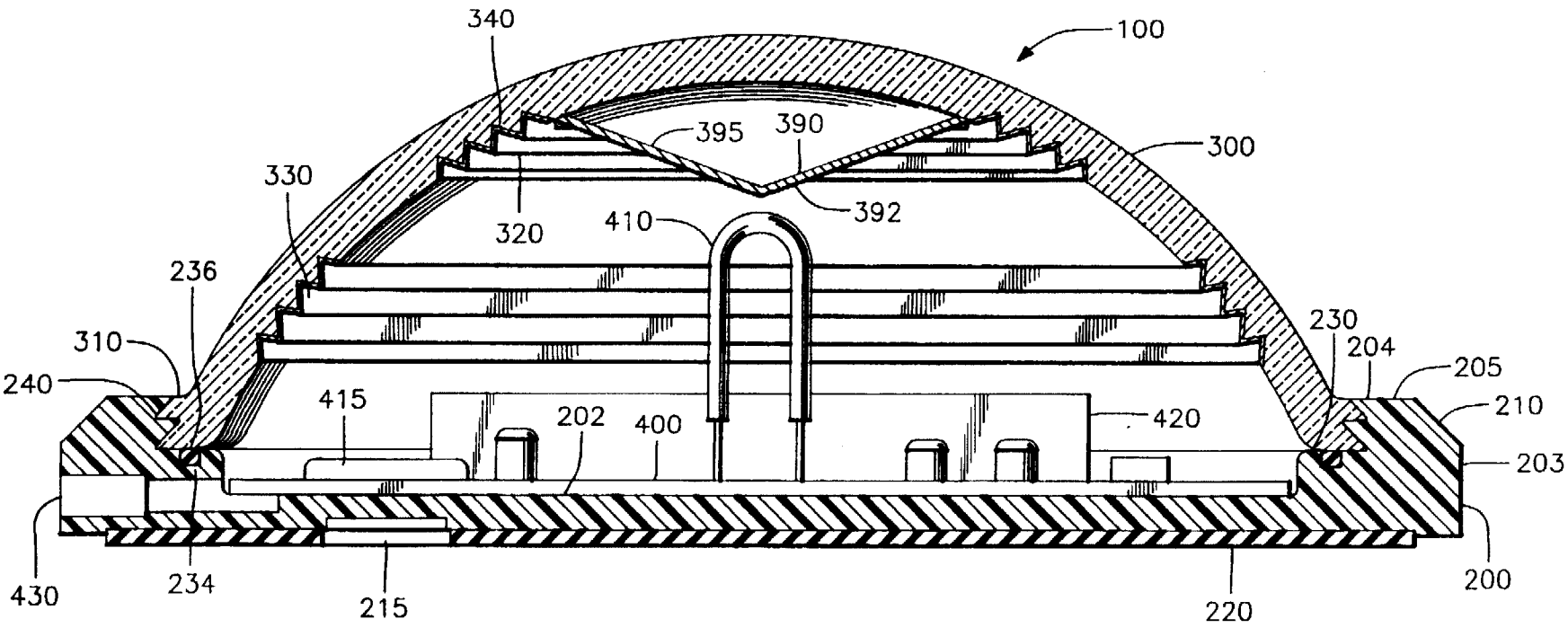
FIG. 3 is a cross-sectional side view of the road beacon taken along line 3—3 of FIG. 2 in accordance with the preferred embodiment of the invention.

As further shown in FIG. 3, base plate 200 has a circular bottom portion 202 having an inside floor 250 (shown in FIG. 2) and an annulus 205 extending around the periphery of the base plate and defining an inner space. Circuit board 400 is mounted to the inner space of base plate 200 in accordance with conventional techniques. Annulus 205 is a raised ring-like structure having a vertical outer edge 203 and a horizontal plane 204 on the exterior of the beacon 100. The horizontal plane 204 meets with the outer edge 203 at a beveled face 210, preferably having a 45 degree slope.

The inside of annulus 205 has a shoulder 230 and buttress thread 240 for mating with dome 300. Shoulder 230 has a groove 234 which contains O-ring 236. O-ring 236 works in conjunction with shoulder 230 to form a tight seal between the base plate 200 and dome 300. In addition, shoulder 230 provides structural support to dome 300 in a vertical direction. Likewise, by providing the annulus 205 on the outer periphery of the bottom portion 202, annulus 205 provides structural support to dome 300 in a horizontal direction. Further, the configuration of annulus 205 and shoulder 230 eliminates undue pressure from buttress threads 240.

Battery recharge receptacle 430 is a circular, narrow and elongated passage that extends through annulus 205 and part of the bottom portion 202 to circuit board 400. Alternatively, the receptacle 430 may extend through the bottom portion 202 from the underside of the base plate 200 or through the annulus 205 alone.

A conventional rubber stopper (not shown) fits inside receptacle 430 to protect against water or dirt entering the interior space of the receptacle 430 when the batteries are not being charged. In addition, circuit board 400 extends flush against the inside of shoulder 230 so that dirt does not enter the interior space of the electronic road beacon 100.

As best shown in FIG. 3, dome 300 includes an outwardly turned lip 310 having buttress threads for mating with the buttress thread 240 of annulus 205. The top of lip 310 is flush with the horizontal plane of annulus 205 when the dome 300 is properly mounted to base plate 200. The interior of the dome 300 contains two sets 320, 330 of 4 concentric radial freznel 340 for a total of 8 freznel 340.

In the preferred embodiment, each of the freznel 340 are reflector surfaces having a colored tint coating. Only the freznel 340 are dyed, rather than the entire dome 300, so that the intensity of light is not diminished. Even though only the freznel 340 are tinted, the entire beacon 100 shows the selected color.

The colors blue, flare red and amber are preferably used to indicate the presence of police or highway patrol, fire fighters or rescue teams, and road utility crews or military, respectively. However, it is recognized that any color tint may be utilized to correspond with a particular setting or operation. In addition, the tint may be omitted altogether. The compactness and durability of the beacon 100 makes it further useful by private motorists or to mark emergency landing strips for helicopters and the like or other uses which will readily occur to those skilled in the art.

The sides of freznel 340 function to blend and intensify light emitted from bulb 410. In addition, freznel 340 are configured so as to direct light emitted from bulb 410 both horizontally and vertically outward from electronic road beacon 100. Accordingly, light is visible from 180 degrees vertically and 360 horizontally to the beacon 100. That is, light emitted from bulb 410 will be visible from all points and in all directions above the horizontal position of the base plate 200.

In the preferred embodiment, the freznel 340 are configured at about 45 degree angles and are cut about one-eighth inch deep into the inner surface of dome 300. The freznel 340 are formed by making an incision on the inside surface of dome 300. The pitch of the incisions may vary along the surface of the dome 300 in order to best focus and direct the light in the particular manner desired.

Preferably, the freznel of upper set 320 are located on dome 300 at positions corresponding to a radius of 1.600, 1.780, 1.940 and 2.070 inches. In accordance with the present invention, these radii correlate to an angle of 25, 28, 31 and 34 degrees from the radial center of dome 300 measured along a vertical line, respectively. Likewise, the lower set 330 of freznel are located on dome 300 at positions corresponding to a radius of 2.800, 2.9250, 3.0500 and 3.1750 inches, or 49, 52, 55 and 59 degrees, respectively.

A reflector 390 is adhered to the interior portion of dome 300 above the upper set 320 of freznel 340. The reflector 390 is formed by applying a reflective coating 392 to backing 395, which is then adhered to dome 300. The reflective coating 392 reflects incident light emitted by bulb 410 downward back into the electronic road beacon 100. The reflector 390 is a vinyl mirror reflector having a plastic material backing 395 and a 1/32 inch of aluminum oxide coating 392.

In the preferred embodiment of FIG. 3, the reflector 390 is an inverted cone-shape vacuum formed vinyl mirror reflector. The conical backing can also be 395 formed by placing an incision along the radius of a 3 inch circle of plastic material to create two ends. The ends are overlapped and curled inward to form a pointed cone in which the base has a 2 inch diameter. Any excess material is removed and the ends of the cone are adhered together in accordance with conventional means. The reflective coating 392 is then applied to backing 395.

Once the cone is formed, the outer edge of the base of the cone is then adhered to the inside of the top of dome 300 with a high grade epoxy or other conventional adhering agent. The cone extends downward toward bulb 410 so that the top of the cone is about ¼ inch from the top of bulb 410. The cone shape reflects incident light out of the beacon 100, increasing the light intensity of bulb 410.

Figure 4:
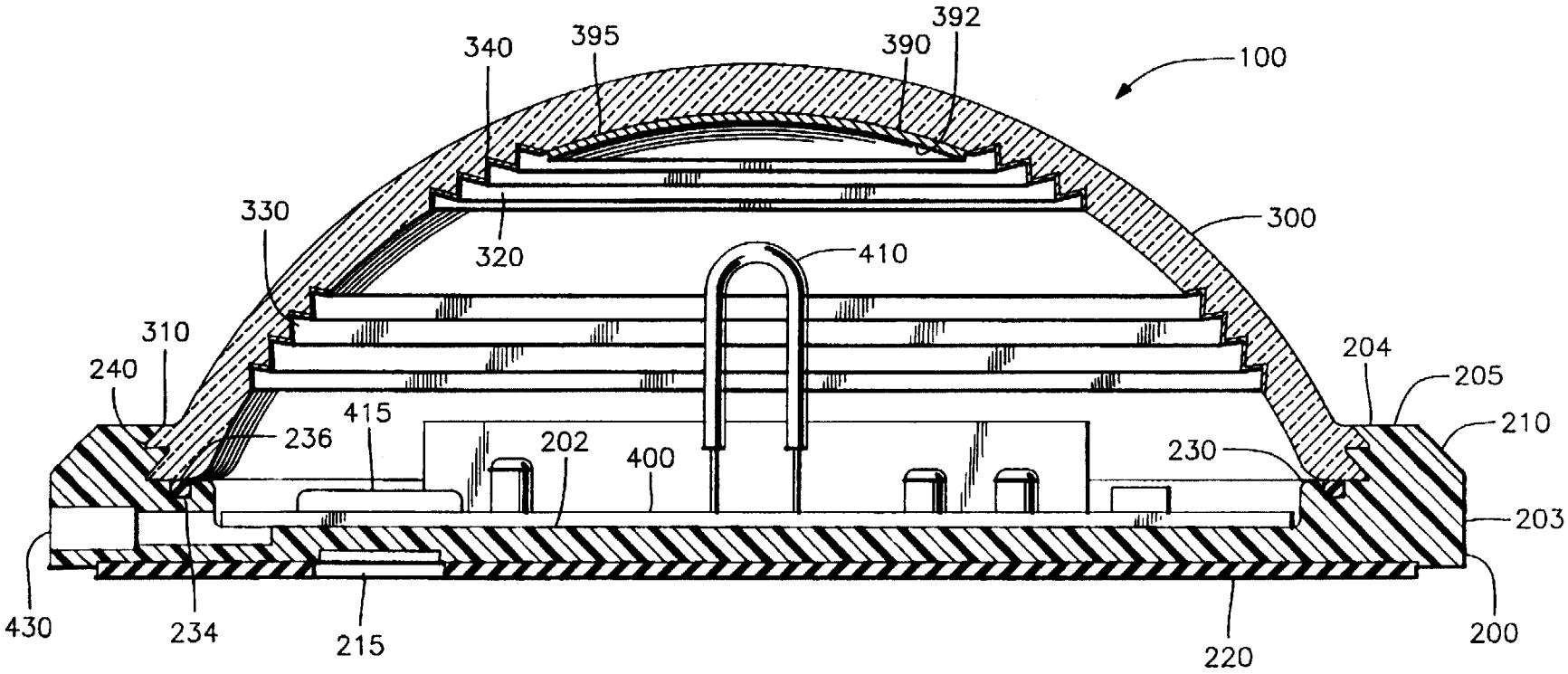
FIG. 4 is a cross-sectional side view of the road beacon taken along line 3—3 of FIG. 2 in accordance with an alternative embodiment of the invention.

In an alternative embodiment shown in FIG. 4, reflector 390 conforms to the shape of the top inside of dome 300. By placing reflector 390 on the inside of dome 300, as opposed to the outside the dome, reflector 390 is protected from damage and closer to bulb 410. Since the reflector 390 is closer to the bulb 410, the light is focused and condensed to a greater degree, thereby increasing the intensity of bulb 410.

Returning briefly to FIG. 2, the floor 250 of bottom portion 202 also preferably contains a reflective coating, such as one made of aluminum oxide, to further reflect incident light outward from beacon 100. Thus, light is reflected from reflector 390 downward to the reflective coating of floor 250. The reflective coating of floor 250, in turn, reflects the light toward freznel 340.

Likewise, the surface of batteries 420 may further be provided with a reflective coating. One of ordinary skill will understand that reflective coating may be applied in any location to best conserve light intensity and direct light in a desired manner. The reflective surfaces function to condense, compress and intensify the light so as to magnify the effectiveness of the light source.

In further accord with the preferred embodiment, reflectors (not shown) can be placed on the outside of the electronic beacon 100. The reflectors reflect light from oncoming car headlights. Reflectors are especially important in the event the bulb 410 burns out or batteries 420 expire. Reflectors are preferably placed around the outside edge 203 of the beacon 100, as well as on the top outside of dome 300, above the conical reflective surface 390.

A reflector may optionally be placed on the inside of dome 300 beneath cone 390 to reduce wear due to a harsh environment. However, placement on the exterior of dome 300 provides an unobstructed use to obtain a maximum reflective effect. Preferably, the reflectors are tinted red, amber or blue.

A non-slip pad 220, such as one made of non-skid rubber, is optionally mounted to the underside of base plate 200. Pad 220 serves to prevent movement of the electronic road beacon 100 from its original placement position. In addition, pad 220 prevents damage to cars or other surfaces upon which the beacon 100 is placed. Pad 220 further provides beacon 100 with added protection against environmental elements. A hole is cut in pad 220 to allow access to the ON/OFF switch (not shown) located in opening 215. The pad 220 may be ribbed or grooved to provide added friction.

In order to withstand the impact of a vehicle, the beacon 100 is designed to be compact and low to the ground. This allows a vehicle to drive over the beacon 100 with minimal interference. In accordance with the preferred embodiments of the invention, the entire beacon 100 is only about 3 inches in height and base plate 200 has a diameter of about 8.53 inches, with dome 300 having a diameter at lip 310 of about 7.5 inches. Heights greater than about 3 inches make the beacon difficult to run over by a car. The beacon may be as small as about 2½ inches in height and 7 inches in diameter, because heights less than about 2½ inches result in poor focusing of the light and therefore diminish illumination for on-coming traffic and the like. When constructed according to the preferred embodiment, the light emitted by beacon 100 is visible from as far away as 10 miles.

The foregoing descriptions and drawings should be considered as illustrative only of the principles of the invention. Numerous applications of the present invention will readily occur to those skilled in the art. For example, though the beacon uses a stationary light source, a rotating light may be used. Likewise, the dome may be in the shape of an ellipse. In addition, there may be any number of freznel used that partly extend in any direction about the dome.

Therefore, it is not desired to limit the invention to the specific examples disclosed or the exact construction and operation shown and described. Rather, all suitable modifications and equivalents may be resorted to, falling within the scope of the invention.

I claim:

1. An electronic road beacon for use as a traffic alert, the electronic road beacon comprising:

a spherical lens having an interior surface and an engaging lip with a top outer surface;

a one-piece solid core base plate having a bottom portion and a raised annulus around the outer periphery of said bottom portion which engages said lip of said lens, said base plate and said lens defining an interior space said annulus has a top outer surface that lies substantially flush with the top outer surface of the lip of said lens when the lip fully engages the annulus, an inside shoulder for structurally supporting said lens, and an exterior beveled edge surface;

said base plate and said lens fitted together to form a movable, free-standing body for said beacon;

a light-emitting bulb and at least one battery mounted to the bottom portion of said base plate in said interior space; and a plurality of concentric radial freznel positioned on the interior surface of said lens to focus light emitted from said bulb.

2. The electronic road beacon of claim 1, wherein the beacon can be driven over by a vehicle.

3. The electronic road beacon of claim 1, wherein said engaging lip has an external thread which engages with an interior thread on said base plate raised annulus.

4. The electronic road beacon of claim 1, wherein said shoulder further includes a groove having an O-ring seal therein to provide a weatherproof seal between said lens and said base plate.

5. The electronic road beacon of claim 1, further comprising a non-slip pad mounted to the underside of said bottom portion.

6. The electronic road beacon of claim 1, further comprising a recharge receptacle comprising a narrow, elongated passage extending through said base plate for receiving an electrical plug to recharge said battery.

7. The electronic road beacon of claim 1, wherein said base plate has a diameter and defines a bottom surface of said beacon, and said lens defines a top surface of said beacon, said top surface and said bottom surfaces defining a height of said beacon, said diameter being substantially greater than said height.

8. An electronic road beacon for use as a traffic alert, the electronic road beacon comprising:

a spherical lens having an interior surface and an engaging lip with a top outer surface;

a one-piece base plate having a bottom portion, a raised annulus around the outer periphery of said bottom portion which engages said lip of said lens, and an inside shoulder for structurally supporting said lens, said base plate and said lens defining an interior space;

a circuit board mounted to the bottom portion of said base plate in said interior space and having a light-emitting bulb and at least one battery; and a plurality of concentric radial freznel positioned on the interior surface of said lens to focus light emitted from said bulb;

a reflective surface located on said bottom portion for reflecting incident light out of said lens.

9. The electronic road beacon in accordance with claim 8 wherein said annulus has a top outer surface that lies substantially flush with the top outer surface of the lip of said lens when the lip fully engages said annulus, and has an exterior bevelled edge surface to aid in maintaining the position of said beacon when struck by a vehicle wheel.

10. An electronic road beacon for use as a traffic alert, the electronic road beacon comprising:

a spherical lens having an interior surface and an engaging lip with a top outer surface;

a one-piece solid core base plate having a bottom portion, a raised annulus around the outer periphery of said bottom portion which engages said lip of said lens, and an inside shoulder for structurally supporting said lens, said base plate and said lens defining an interior space;

a circuit board mounted to the bottom portion of said base plate in said interior space and having a light-emitting bulb and at least one battery;

a plurality of concentric radial freznel positioned on the interior surface of said lens to focus light emitted from said bulb; and a reflector placed on at least a portion of said interior surface of said lens.

11. The electronic road beacon of claim 10, wherein said reflector further comprises a cone shape extending downward from the top interior surface of said lens.

12. A portable electronic road beacon for use as a traffic alert, the electronic road beacon comprising:

a spherical lens having an interior surface and an outward turned lip having an exterior thread;

a one-piece solid core base plate having a bottom portion and an upright annulus along the outer periphery of said bottom portion with an interior thread for engaging the exterior thread of said lip;

said base plate and said lens forming a free-standing body for said beacon and defining an interior space and said annulus having a top outer surface, an inside shoulder for structurally supporting said lens, and an exterior beveled face; and a light-emitting bulb and at least one battery mounted to the bottom portion of said base plate in said interior space.

13. The electronic road beacon of claim 10, further comprising a plurality of concentric radial freznel positioned on the interior surface of said lens to focus light emitted from said bulb.

14. The electronic road beacon of claim 12, wherein the beacon can be driven over by a vehicle.

15. The electronic road beacon of claim 12, wherein said shoulder further comprises a groove having an O-ring seal to provide a weatherproof seal between said lens and said base plate.

16. The electronic road beacon of claim 12, further comprising a non-slip pad mounted to the underside of said bottom portion.

17. The electronic road beacon of claim 12, further comprising a recharge receptacle comprising a narrow, elongated passage extending through said base plate for receiving an electrical plug to recharge said battery.

18. The electronic road beacon of claim 12, wherein said base plate has a diameter and defines a bottom surface of said beacon, and said lens defines a top surface of said beacon, said top surface and said bottom surfaces defining a height of said beacon, said diameter being substantially greater than said height.

19. An electronic road beacon which comprises:

a spherical lens having an interior surface and an outward turned lip having an exterior thread;

a one-piece solid core base plate having a bottom portion and an upright annulus along the outer periphery of said bottom portion with an interior thread for engaging the exterior thread of said lip, wherein said base plate and said lens define an interior space;

a circuit board mounted to the bottom portion of said base plate in said interior space and having a light-emitting bulb and at least one battery; and a reflective surface located on said bottom portion for reflecting incident light out of said lens.

20. The electronic road beacon in accordance with claim 19 wherein said annulus has an inside shoulder for structurally supporting said lens and a top outer surface with a bevelled edge to aid in maintaining the position of said beacon when struck by a vehicle wheel.

21. An electronic road beacon which comprises:

a spherical lens having an interior surface and an outward turned lip having an exterior thread;

a one-piece solid core base plate having a bottom portion and an upright annulus along the outer periphery of said bottom portion with an interior thread for engaging the exterior thread of said lip, wherein said base plate and said lens define an interior space;

a circuit board mounted to the bottom portion of said base plate in said interior space and having a light-emitting bulb and at least one battery; and a reflector placed on at least a portion of said interior surface of said lens.

22. The electronic road beacon of claim 21, wherein said reflector further comprises a cone shape extending downward from the top interior surface of said lens.

23. An electronic road beacon for use as a traffic alert, the electronic road beacon comprising:

a spherical lens having an interior surface and an engaging lip with a top outer surface;

a one-piece solid core base plate having a bottom portion, a raised annulus around the outer periphery of said bottom portion which engages said lip of said lens, and an inside shoulder for structurally supporting said lens, said base plate and said lens defining an interior space;

a circuit board mounted to the bottom portion of said base plate in said interior space and having a light-emitting bulb and at least one battery;

a plurality of concentric radial freznel positioned on the interior surface of said lens to focus light emitted from said bulb; and said base plate having a diameter and defining a bottom surface of said beacon, and said lens defining a top surface of said beacon, said top surface and said bottom surface defining a height of said beacon, wherein said height is on the order of about 3 inches, and said diameter is at least approximately 2.8 times said height.

24. The electronic road beacon in accordance with claim 23 wherein said annulus has a top outer surface that lies substantially flush with the top outer surface of the lip of said lens when the lip fully engages said annulus, and has an exterior bevelled edge surface to aid in maintaining the position of said beacon when struck by a vehicle wheel.

25. An electronic road beacon which comprises:

a spherical lens having an interior surface and an outward turned lip having an exterior thread;

a one-piece solid core base plate having a bottom portion and an upright annulus along the outer periphery of said bottom portion with an interior thread for engaging the exterior thread of said lip, wherein said base plate and said lens define an interior space;

a circuit board mounted to the bottom portion of said base plate in said interior space and having a light-emitting bulb and at least one battery; and said base plate having a diameter and defining a bottom surface of said beacon, and said lens defining a top surface of said beacon, said top surface and said bottom surface defining a height of said beacon, and wherein said height is on the order of about 3 inches, and said diameter is at least approximately 2.8 times said height.

26. The electronic road beacon in accordance with claim 25 wherein said annulus has an inside shoulder for structurally supporting said lens and a top outer surface with a bevelled edge to aid in maintaining the position of said beacon when struck by a vehicle wheel.

27. A generally circular electronic road beacon for use as a traffic alert which is capable of withstanding the impact of a vehicle which comprises a generally flat circular base plate and a generally circular dome made of high strength, high impact molded plastic mounted on said base to form a movable and free-standing body for said beacon with a spherical lens over said base plate and a sealed interior space protected from weather and other harmful conditions, at least one battery and at least one light emitting bulb mounted to said base plate within said sealed interior space, said body having a vertical height and a horizontal width with said horizontal width being substantially greater than said height.

28. The circular electronic road beacon of claim 27 wherein said dome includes concentric freznel on the interior thereof.

29. The circular electronic road beacon of claim 27 wherein a light reflector is included in said sealed interior space.

30. The circular electronic road beacon of claim 27 wherein said dome has a generally horizontal engaging lip extending around its peripheral edge which is threadingly engaged inside an upstanding annular ring of said base plate.

31. The circular electronic road beacon in accordance with claim 30 wherein said engaging lip has a top outer surface and said annular ring has a top outer surface that lies flush with the top outer surface of said lip when said dome lip is fully engaged with the base plate annular ring.

32. The circular electronic road beacon in accordance with claim 30 wherein said engaging lip has a lower surface and said base plate has a generally horizontal shoulder inside said annular ring to support said dome in said base plate, and a seal engaging said lip lower surface and said base plate shoulder when said dome lip is fully engaged with the base plate annular ring to seal said interior space.

33. The circular electronic road beacon in accordance with claim 32 wherein said seal is a continuous ring seal.

34. The electronic road beacon in accordance with claim 23, wherein said height is on the order of about 3 inches, and said diameter is at least approximately 2.8 times said height.

35. A portable electronic beacon which comprises a base member that is movably positionable on a roadway surface, a dome member connected with said base member to form a spherical lens above said base member, said base member and said lens made of high strength, high impact material sufficient to withstand impact with a moving vehicle wheel, a protected interior space closed by said dome member above said base member, at least one battery and at least one light emitting bulb mounted in said interior space, and a generally circular seal positioned against an interior surface of said dome member to substantially seal said interior space from water and dirt entering said space.

36. A portable electronic beacon in accordance with claim 35 and further including a plurality of concentric radial freznel positioned on the interior surface of said spherical lens to focus light emitted from said bulb.

37. A portable electronic beacon in accordance with claim 36 wherein said freznel are configured at about 45° angles on said interior surface of said spherical lens.

38. A portable electronic beacon which comprises a base member that is movably positionable on a roadway surface, a spherical lens connected with and positioned above said base member to form a protected interior space, said base member and said spherical lens made of high strength, high impact material sufficient to withstand impact with a moving vehicle wheel and configured to maintain said beacon in an upright position on the roadway surface after impact with said moving vehicle wheel, at least one battery and at least one light emitting bulb positioned in said protected interior space, and a plurality of freznel positioned on an interior surface of said spherical lens to focus light emitted from said bulb to the exterior of said beacon.

39. A portable electronic beacon in accordance with claim 38 wherein said freznel are configured at about 45° angles and are cut about ⅛ inch deep in said interior surface of said spherical lens.

* * * * *